US009396732B2

(12) United States Patent
Li et al.

(10) Patent No.: US 9,396,732 B2
(45) Date of Patent: Jul. 19, 2016

(54) HIERARCHICAL DECCORELATION OF MULTICHANNEL AUDIO

(71) Applicants: Minyue Li, Beijing (CN); Willem Bastiaan Kleijn, Lower Hutt (NZ); Jan Skoglund, San Francisco, CA (US)

(72) Inventors: Minyue Li, Beijing (CN); Willem Bastiaan Kleijn, Lower Hutt (NZ); Jan Skoglund, San Francisco, CA (US)

(73) Assignee: GOOGLE INC., Mountain View, CA (US)

( * ) Notice: Subject to any disclaimer, the term of this patent is extended or adjusted under 35 U.S.C. 154(b) by 716 days.

(21) Appl. No.: 13/655,225

(22) Filed: Oct. 18, 2012

(65) Prior Publication Data

US 2014/0112481 A1 Apr. 24, 2014

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... G10L 19/24; G10L 19/008
USPC ..... 381/22–23, 17; 704/500–501
See application file for complete search history.

(56) References Cited

U.S. PATENT DOCUMENTS 7,502,743 B2 3/2009 Thumpudi et al.
8,548,615 B2 * 10/2013 Ojanpera ..... G10L 19/008 381/17
8,977,542 B2 * 3/2015 Norvell ..... G10L 19/038 704/205
2009/0022328 A1 * 1/2009 Neugebauer ..... H04S 1/005 381/27
2011/0249821 A1 * 10/2011 Jaillet ..... G10L 19/008 381/22
2013/0064374 A1 * 3/2013 Lee ..... H04S 3/004 381/17

OTHER PUBLICATIONS

Houcem Gazzah et al., "Asymptotic Eigenvalue Distribution of Block Toeplitz Matrices and Application to Blind SIMO Channel Idenitification", IEEE Transactions of Information Theory, vol. 47, No. 3, Mar. 2001, pp. 1243-1251.
Phoong et al., "Prediction-Based Lower Triangular Transform", IEEE Transactions on Signal Processing, vol. 48, No. 7, Jul. 2000.
Weng et al., "Generalized Triangular Decomposition in Transform Coding", IEEE Transactions on Signal Processing, vol. 58, No. 2, Feb. 2010.

* cited by examiner

*Primary Examiner* — Disler Paul
(74) *Attorney, Agent, or Firm* — Birch, Stewart, Kolasch & Birch, LLP

(57) ABSTRACT

Provided are methods, systems, and apparatus for hierarchical decorrelation of multichannel audio. A hierarchical decorrelation algorithm is designed to adapt to possibly changing characteristics of an input signal, and also preserves the energy of the original signal. The algorithm is invertible in that the original signal can be retrieved if needed. Furthermore, the proposed algorithm decomposes the decorrelation process into multiple low-complexity steps. The contribution of these steps is generally in a decreasing order, and thus the complexity of the algorithm can be scaled.

22 Claims, 8 Drawing Sheets

HIERARCHICAL DECCORELATION OF MULTICHANNEL AUDIO

TECHNICAL FIELD

The present disclosure generally relates to methods, systems, and apparatus for signal processing. More specifically, aspects of the present disclosure relate to decorrelating multichannel audio using a hierarchical algorithm.

BACKGROUND

Multichannel audio shows correlation across channels (e.g., wherein "channel" as used herein refers to a channel by one of the sequences in a multi-dimensional source signal). Removing the correlation can be beneficial to compression, noise suppression, and source separation. For example, removing the correlation reduces the redundancy and thus increases compression efficiency. Furthermore, noise is generally uncorrelated with sound sources. Therefore, removing the correlation helps to separate noise from sound sources. Also, sound sources are generally uncorrelated, and thus removing the correlation helps to identify the sound sources.

With cross-channel prediction, there is no preservation of signal energy. In approaches that use fixed matrixing (e.g., as used in CELT, Vorbis), there is no adaptation to signal characteristics. Approaches that use downmixing (e.g., as used in HE-AAC, MPEG Surround) are non-invertible. Additionally, Karhunen-Loève transform (KLT)/principle component analysis (PCA) (e.g., as used in MAACKLT3, PCA-based primary-ambience decomposition), when carried out in a conventional manner, is computationally difficult.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for decorrelating channels of an audio signal, the method comprising: selecting a plurality of the channels of the audio signal based on at least one criterion; performing a unitary transform on the selected plurality of channels, yielding a plurality of decorrelated channels; combining the plurality of decorrelated channels with remaining channels of the audio signal other than the selected plurality; and determining whether to further decorrelate the combined channels based on computational complexity.

In another embodiment, the method for decorrelating channels of an audio signal further comprises, responsive to determining not to further decorrelate the combined channels, passing the combined channels as output.

Another embodiment of the disclosure relates to a method for encoding an audio signal comprised of a plurality of channels, the method comprising: segmenting the audio signal into frames; transforming each of the frames into a frequency domain representation; estimating, for each frame, a signal model; quantizing the signal model for each frame; performing hierarchical decorrelation using the frequency domain representation and the quantized signal model for each of the frames; and quantizing an outcome of the hierarchical decorrelation using a quantizer.

In yet another embodiment, the step of performing hierarchical decorrelation in the method for encoding an audio signal includes: selecting a set of channels, of the plurality of channels of the audio signal, based on number of bits saved for audio compression; performing a unitary transform on the selected set of channels, yielding a set of decorrelated channels; and combining the set of decorrelated channels with remaining channels of the plurality other than the selected set.

In another embodiment, the step of performing hierarchical decorrelation in the method for encoding an audio signal further includes: determining whether to further decorrelate the combined channels based on computational complexity; and responsive to determining not to further decorrelate the combined channels, passing the combined channels as output.

Still another embodiment of the present disclosure relates to a method for suppressing noise in an audio signal comprised of a plurality of channels, the method comprising: segmenting the audio signal into frames; transforming each of the frames into a frequency domain representation; estimating, for each frame, a signal model; quantizing the signal model for each frame; performing hierarchical decorrelation using the frequency domain representation and the quantized signal model for each of the frames to produce a plurality of decorrelated channels; setting one or more of the plurality of decorrelated channels with low energy to zero; performing inverse hierarchical decorrelation on the plurality of decorrelated channels; and transforming the plurality of decorrelated channels to the time domain to produce a noise-suppressed signal.

In another embodiment, the step of performing hierarchical decorrelation in the method for suppression noise further includes: selecting a set of channels, of the plurality of channels of the audio signal, based on degree of energy concentration; and performing a unitary transform on the selected set of channels, yielding a set of decorrelated channels.

Another embodiment of the disclosure relates to a method for separating sources of an audio signal comprised of a plurality of channels, the method comprising: segmenting the audio signal into frames; estimating, for each frame, a signal model; performing hierarchical decorrelation using the audio signal and the signal model for each of the frames to produce a plurality of decorrelated channels; reordering the plurality of decorrelated channels based on energy of each decorrelated channel; and combining the frames to obtain a source separated version of the audio signal.

In yet another embodiment, the step of performing hierarchical decorrelation in the method for separating sources of an audio signal further includes: selecting a set of channels, of the plurality of channels of the audio signal, based on minimizing remaining correlation across the plurality of channels; and performing a unitary transform on the selected set of channels, yielding a set of decorrelated channels.

Still another embodiment of the disclosure relates to a method for encoding an audio signal comprised of a plurality of channels, the method comprising: segmenting the audio signal into frames; normalizing each of the frames of the audio signal to obtain a constant signal-to-noise ratio (SNR) in each of the plurality of channels; performing hierarchical decorrelation on the frames using a unitary transform in time domain, yielding a plurality of decorrelated channels; transforming the plurality of decorrelated channels to frequency domain; applying one or more weighting terms to the plurality of decorrelated channels; quantizing the plurality of decorrelated channels with the weighting terms to obtain a quantized audio signal; and encoding the quantized audio signal using an entropy coder to produce an encoded bit stream.

In another embodiment, the method for encoding an audio signal further comprises extracting power spectral densities (PSDs) for the plurality of decorrelated channels.

Another embodiment of the disclosure relates to a system for encoding a multichannel audio signal, the system comprising one or more mono audio coders and a hierarchical decorrelation component, wherein the hierarchical decorrelation component is configured to: select a plurality of channels of the audio signal based on at least one criterion; perform a unitary transform on the selected plurality of channels, yielding a plurality of decorrelated channels; combine the plurality of decorrelated channels with remaining channels of the audio signal other than the selected plurality; and output the combined channels to the one or more mono audio coders.

In yet another embodiment of the system for encoding a multichannel audio signal, the hierarchical decorrelation component is further configured to: determine whether the combined channels should be further decorrelated based on computational complexity; and responsive to determining that the combined channels should not be further decorrelated, pass the combined channels as output to the one or more audio coders.

In yet another embodiment of the system for encoding a multichannel audio signal, the hierarchical decorrelation component is further configured to stop decorrelating the combined channels when a predefined maximum cycle is reached.

In still another embodiment of the system for encoding a multichannel audio signal, the hierarchical decorrelation component is further configured to stop decorrelating the combined channels when the gain factor at a cycle is close to zero.

In another embodiment of the system for encoding a multichannel audio signal, the one or more mono audio coders is configured to: receive the combined channels from the hierarchical decorrelation component in the time domain; transform the combined channels to frequency domain; apply one or more weighting terms to the combined channels; quantize the combined channels with the weighting terms to obtain a quantized audio signal; and encode the quantized audio signal to produce an encoded bit stream.

In one or more embodiments, the methods, systems, and apparatus described herein may optionally include one or more of the following additional features: the at least one criterion is number of bits saved for audio compression, degree of energy concentration, or remaining correlation; selecting the plurality of channels includes identifying one or more of the channels of the audio signal having a higher energy concentration than the remaining channels; selecting the plurality of channels includes identifying one or more of the channels of the audio signal that saves the most bits for audio compression; selecting the plurality of channels includes identifying one or more of the channels of the audio signal that minimizes remaining correlation; the unitary transform is a Karhunen-Loève transform (KLT); the plurality of channels is two; the estimated signal model for each frame yields a spectral matrix; and/or the unitary transform is calculated from the quantized signal model.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the invention will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which four a part of this specification. In the drawings:

Figure 1:
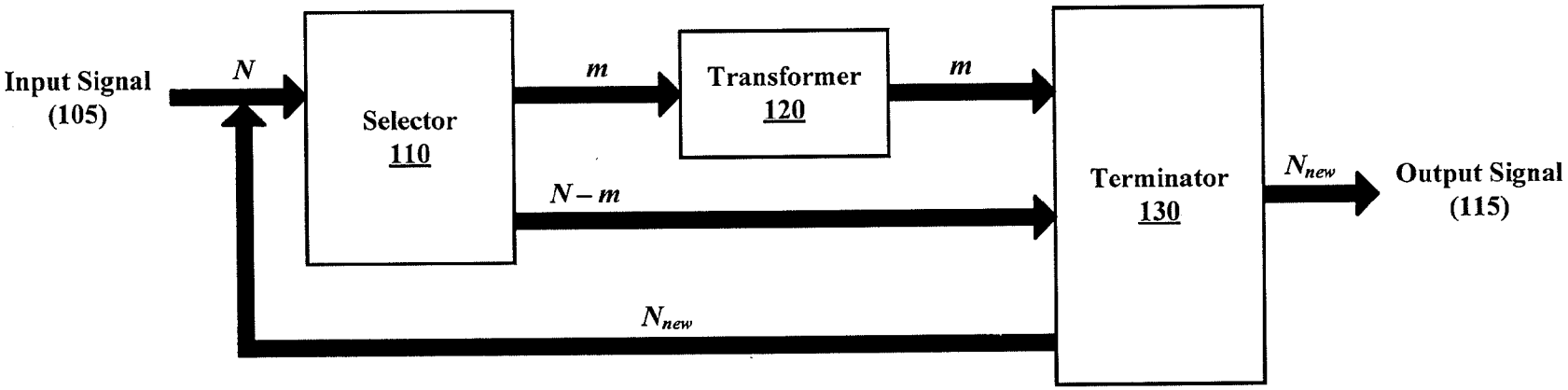
FIG. 1 is a block diagram illustrating an example structure for hierarchical decorrelation of multichannel audio according to one or more embodiments described herein.

The headings provided herein are for convenience only and do not necessarily affect the scope or meaning of the claimed invention.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other obvious features not described in detail herein. Additionally, some well-known structures or functions may not be shown or described in detail below, so as to avoid unnecessarily obscuring the relevant description.

Embodiments of the present disclosure relate to methods, systems, and apparatus for hierarchical decorrelation of multichannel audio. As will be further described below, the hierarchical decorrelation algorithm of the present disclosure is adaptive, energy-preserving, invertible, and complexity-scalable. For example, the hierarchical decorrelation algorithm described herein is designed to adapt to possibly changing characteristics of an input signal, and also preserves the energy of the original signal. The algorithm is invertible in that the original signal can be retrieved if needed. Furthermore, the proposed algorithm decomposes the decorrelation process into multiple low-complexity steps. In at least some embodiments the contribution of these steps is in a decreasing order, and thus the complexity of the algorithm can be scaled.

The following sections provide an overview of the basic structure of the hierarchical decorrelation algorithm together with three exemplary applications, namely audio compression, noise suppression, and source separation.

FIG. 1 provides a structural overview of the hierarchical decorrelation algorithm for multichannel audio according to one or more embodiments described herein.

In at least one embodiment, hierarchical decorrelation includes a channel selector 110, a transformer 120, and a terminator 130. An input signal 105 consisting of N channels is input into the channel selector 110, which selects m channels out of the N input channels to perform decorrelation on. The selector 110 may select the m channels according to a number of different criteria (e.g., number of bits saved for compression, degree of energy concentration, remaining correlation, etc.), which may vary depending on the particular application (e.g., audio compression, noise suppression, source separation, etc.).

The channel selector 110 passes the m channels to the transformer 120. The transformer 120 performs a unitary transform on the selected m channels, resulting in m decorrelated channels. In at least one embodiment, the unitary transform performed by the transformer 120 is KLT. Following the transform, the m channels are passed to the terminator 130 where they are combined with the remaining N-m channels to form an N-channel signal again. The terminator 130 either feeds the newly combined signal $N_{new}$ back to the channel selector 110 for another decorrelation cycle or passes the newly combined signal $N_{new}$ as output signal 115. The decision by the terminator 130 to either return the signal to the selector 110 for further decorrelation or instead pass the newly combined signal as output 115 may be based on a number of different criteria, (e.g., computational complexity), which may vary depending on the particular application (e.g., audio compression, noise suppression, source separation, etc.).

According to one embodiment of the present disclosure, the hierarchical decorrelation algorithm described herein may be implemented as part of audio compression processing. An example purpose for applying hierarchical decorrelation to audio compression is, given a multichannel audio signal, to reduce the size of the signal while maintaining its perceptual quality. As will be further described below, implementing hierarchical decorrelation in audio compression allows for exploiting the redundancy among channels with high efficiency and low complexity. Further, the adjustable trade-off between efficiency and complexity in such an application allows the particular use to be tailored as necessary or desired.

Several key features of the following application of hierarchical decorrelation to audio compression processing include: (1) the application is a frequency domain calculation; (2) two channels are selected each cycle (m=2); (3) channel selection is based on the bits saved; and (4) termination is based on complexity. It should be understood that the above features/constraints are exemplary in nature, and one or more of these features may be removed and/or altered depending on the particular implementation.

Additionally, the following application of hierarchical decorrelation to audio compression includes performing KLT on two channels with low complexity. As will be described in greater detail below, a spectral matrix consisting of two self power-spectral-densities (PSD) and a cross-PSD is received in at least one embodiment of the application. An analytic expression for KLT is available, which may not necessarily be the case when there are more than two channels involved.

An analytic expression of KLT on two channels is described below. The following considers a two-channel signal $\{x_1(t), x_2(t)\}$ with a spectral matrix of the form $$S(\omega) = \begin{bmatrix} S^{1,1}(\omega) & S^{1,2}(\omega) \\ \overline{S}^{1,2}(\omega) & S^{2,2}(\omega) \end{bmatrix}. \tag{1}$$

In equation (1), $S^{1,1}(\omega)$ and $S^{2,2}(\omega)$ denote the self-PSD of $x_1(t)$ and $x_2(t)$, respectively, $S^{1,2}(\omega)$ denotes the cross-PSD of $x_1(t)$ and $x_2(t)$, and $\overline{S}^{1,2}(\omega)$ is the complex conjugate of $S^{1,2}(\omega)$.

Denoting the frequency representation of the signal $\{x_1(t), x_2(t)\}$ as $\{X_1(\omega), X_2(\omega)\}$, the KLT may be written as $$\begin{bmatrix} Y_1(\omega) \\ Y_2(\omega) \end{bmatrix} = \frac{1}{(1+|G(\omega)|^2)^{\frac{1}{2}}} \begin{bmatrix} 1 & G(\omega) \\ -\overline{G}(\omega) & 1 \end{bmatrix} \begin{bmatrix} X_1(\omega) \\ X_2(\omega) \end{bmatrix}, \tag{2}$$

where $$G(\omega) = \frac{2S^{1,2}(\omega)}{S^{1,1}(\omega) - S^{2,2}(\omega) + ((S^{1,1}(\omega) - S^{2,2}(\omega))^2 + 4|S^{1,2}(\omega)|^2)^{\frac{1}{2}}}. \tag{3}$$

The resulted processes, whose frequency representations are denoted by $Y_1(\omega)$ and $Y_2(\omega)$, are in principle uncorrelated.

The KLT is straightforward to perform in the frequency domain as multiplication as shown above in equation (2). However, the transform can also be performed in the time domain as filtering. In at least one embodiment, the hierarchical decorrelation is accomplished by time domain operations.

Figure 2:
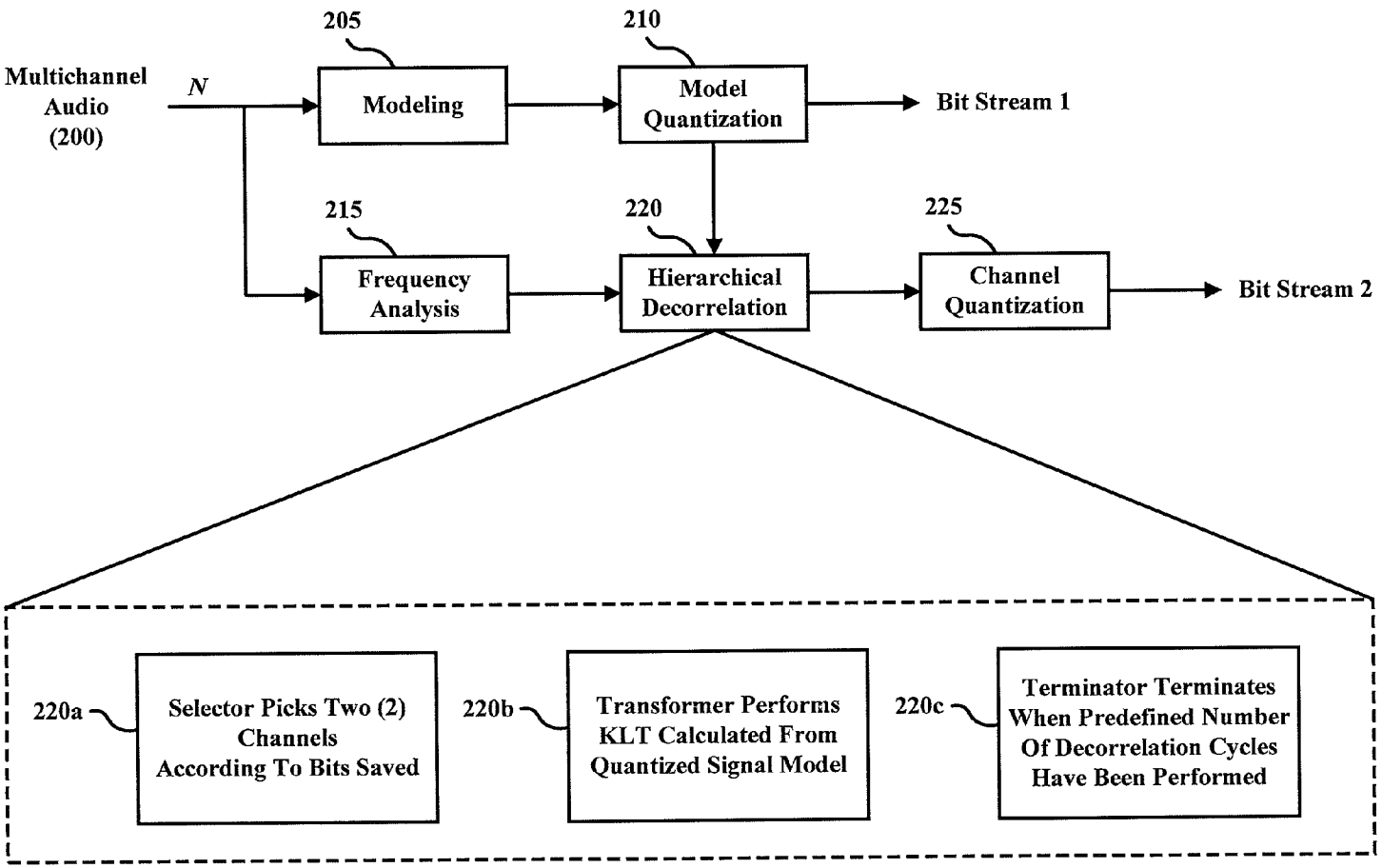
FIG. 2 is a block diagram illustrating an example encoding process for applying hierarchical decorrelation to audio compression processing according to one or more embodiments described herein.
Figure 3:
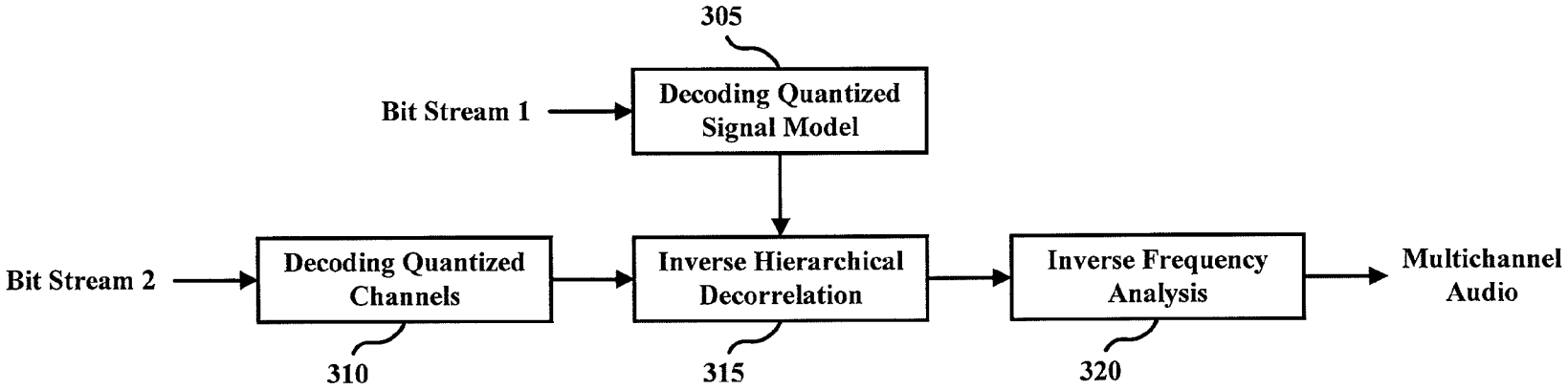
FIG. 3 is a block diagram illustrating an example decoding process for applying hierarchical decorrelation to audio compression processing according to one or more embodiments described herein.

The following description makes reference to FIGS. 2 and 3, which illustrate encoding and decoding processes, respectively, according to at least one embodiment of the disclosure. The encoding and decoding processes shown in FIGS. 2 and 3 may comprise a method for audio compression using the hierarchical decorrelation technique described herein.

FIG. 2 illustrates an example encoding process (e.g., by an encoder) in which an audio signal 200 consisting of N channels undergoes a series of processing steps including modeling 205, model quantization 210, frequency analysis 215, hierarchical decorrelation 220, and channel quantization 225. Upon being received, the audio signal 200 is segmented into frames and each frame transformed into a frequency domain representation by undergoing frequency analysis 215. For each frame of the signal 200, a signal model, which yields a spectral matrix, may be extracted and quantized in the modeling 205 and model quantization 210 steps of the process. In at least one embodiment, the signal model may be quantized using a conventional method known to those skilled in the art.

The frequency representation may be fed with the quantized signal model into hierarchical decorrelation 220, which may proceed in a manner similar to the hierarchical decorrelation algorithm illustrated in FIG. 1 and described in detail above. For example, in at least one embodiment, hierarchical decorrelation 220 may be performed with the following example configuration (represented in FIG. 2 by steps/components 220*a*, 220*b*, and 220*c*):

In 220*a*, the Selector (e.g., Selector 110 as shown in FIG. 1) picks the two (2) channels that save the most bits if a decorrelation operation is performed upon them.

In 220*b*, the Transformer (e.g., Transformer 120 as shown in FIG. 1) performs KLT, which is calculated from the quantized signal model (e.g., obtained from the modeling 205 and model quantization 210 steps illustrated in FIG. 2).

In 220*c*, the Terminator (e.g., Terminator 130 as shown in FIG. 1) terminates the decorrelation stage when a predefined number of decorrelation cycles have been performed (e.g., based on the computational complexity).

The outcome of the hierarchical decorrelation 220 may then be quantized during channel quantization 225, which may be performed by a conventional quantizer known to those skilled in the art. Both "bit stream 1" and "bit stream 2" are the output of the encoding process illustrated in FIG. 2.

Referring now to FIG. 3, illustrated is an example decoding process (e.g., performed by a decoder) for the bit streams (e.g., "bit stream 1" and "bit stream 2") output by the encoding process described above. In at least the example embodiment shown, a decoder may perform decoding of the quantized signal model 305, decoding of quantized channels 310, inverse hierarchical decorrelation 315, and inverse frequency analysis 320.

The bit stream 1 may be decoded to obtain a quantized signal model. The bit stream 2 may also be decoded to obtain quantized signals from the decorrelated channels. The decoder may then perform the inverse of the hierarchical decorrelation 315 used in the encoding process described above and illustrated in FIG. 2. For example, if the hierarchical decorrelation performs $KLT_1$ on channel_set(1), $KLT_2$ on channel_set(2), up through $KLT_t$ on channel_set(t) (where "t" is an arbitrary number), then the inverse processing performs Inverse $KLT_t$ on channel_set(t), Inverse $KLT_2$ on channel_set (2), and Inverse $KLT_1$ on channel_set(1), where Inverse KLT is known to those skilled in the art. Following the inverse of the hierarchical decorrelation 315, the decoder may then perform the inverse of the frequency analysis 320 used in encoding to obtain a coded version of the original signal.

Another embodiment of the application of hierarchical decorrelation to audio compression processing will now be described with reference to FIG. 4. In this embodiment, the hierarchical decorrelation is used as pre-processing to one or more mono audio coders. Any existing mono coder may work. In the embodiment illustrated in FIG. 4 and described below, an example mono coder is used.

To be used as pre-processing to one or more mono audio coders, the hierarchical decorrelation according to this embodiment is implemented with two features: (1) the operations are in time domain so as to facilitate the output of a time-domain signal; and (2) the transmission of information about the hierarchical decorrelation is made small.

Figure 4:
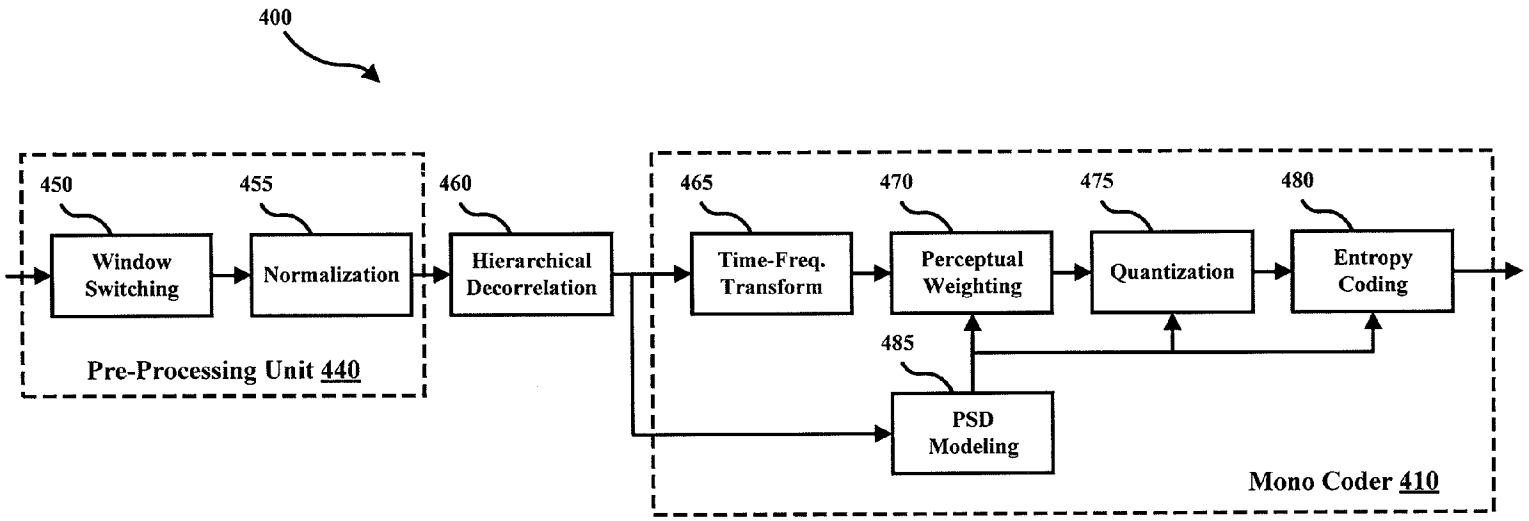
FIG. 4 is a block diagram illustrating an example system for encoding an audio signal including a hierarchical decorrelation component and one or more mono audio coders according to one or more embodiments described herein.

As with the preceding embodiment described above and illustrated in FIGS. 2 and 3, the hierarchical decorrelation component 460 illustrated in FIG. 4 selects two channels (e.g., from a plurality of channels comprising an input audio signal) and decorrelates them according to the analytic expression in equation (2), at each cycle. One potential issue of using the implementation of the hierarchical decorrelation in the preceding embodiment described above and illustrated in FIGS. 2 and 3 is that the transmission of the spectral matrix can be costly and wasteful when the hierarchical decorrelation is used in conjunction with some existing mono audio coders.

To reduce the transmission, the KLT may be simplified according to the following assumption. Suppose there is a sound source that takes different paths to reach two microphones, respectively, generating a 2-channel signal. Each path is characterized by a decay and a delay. The self-spectra and the cross-spectrum of the 2-channel signal may be written as $$S^{1,1}(\omega)=a^2S(\omega), \tag{4}$$

$$S^{2,2}(\omega)=b^2S(\omega), \tag{5}$$

$$S^{1,2}(\omega)=ab\exp(jd\omega)S(\omega), \tag{6}$$

where S(ω) denotes the PSD of the sound source. As such, equation (3) may be written as $$G(\omega) = \frac{b}{a}\exp(jd\omega) = g\exp(jd\omega) \tag{7}$$

Therefore, it is enough to describe the KLT by a gain and a delay factor.

Practical situations are generally more complicated than the two-path modeling of a 2-channel signal. However, repeating this modeling along the iterations of the hierarchical decorrelation may lead to nearly optimal performance for most cases.

In at least one embodiment, the KLT (equation (2) is realized in time domain. Using the parameterization of the transform matrix (e.g., equation (7), the KLT may be rewritten as $$y_1(t) = \frac{1}{\sqrt{1+g^2}}(x_1(t) + gx_2(t+d)), \tag{8}$$

$$y_2(t) = \frac{1}{\sqrt{1+g^2}}(-gx_1(t-d) + x_2(t)). \tag{9}$$

The gain and the delay factor can be obtained in multiple ways. In at least one embodiment, the cross-correlation function between the two channels is calculated and the delay is defined as the lag that corresponds to the maximum of the cross-correlation function. The gain may then be obtained by $$g = \frac{\sum_t x_1(t-d)x_2(t)}{\sum_t x_1(t-d)^2}. \tag{10}$$

In one or more embodiments, the terminator (e.g., terminator 130 as shown in FIG. 1) stops the hierarchical decorrelation when a predefined maximum cycle is reached or the gain factor at a cycle is close to zero. In this way, a good balance between the performance and the computation or transmission cost can be achieved.

A full multichannel audio coder can be built upon the hierarchical decorrelation of the present disclosure followed by a mono audio coder applied to each decorrelated signal. An example structure of a complete multichannel audio coder according to at least one embodiment described herein is illustrated in FIG. 4.

FIG. 4 illustrates a system 400 for encoding an audio signal comprised of a plurality of a channels in which the system includes a hierarchical decorrelation component 460 and one or more mono audio coders 410. The system 400 (which may also be considered a multichannel audio coder) may further include a pre-processing unit 440 configured to perform various pre-processing operations prior to the hierarchical decorrelation. In the system shown in FIG. 4, the pre-processing unit 440 includes a window switching component 450 and a normalization component 455. Additional pre-processing components may also be part of the pre-processing unit 440 in addition to or instead of window switching component 450 and/or normalization component 455.

The window switching component 450 selects a segment of the input audio to perform the hierarchical decorrelation 460 and coding. The normalization component 455 tries to capture some temporal characteristics of auditory perception. In particular, the normalization component 455 normalizes the signal from each channel, so as to achieve a relatively constant signal-to-noise ratio (SNR) in each channel. For example, in at least one embodiment, each of the frames of the audio signal is normalized against its excitation power (e.g., the power of the prediction error of the optimal linear prediction) since perceptually justifiable quantization noise should roughly follow the spectrum of the source signal, and the SNR is hence roughly defined by the excitation power.

The one or more mono audio coders 410 applies a time-frequency transform 465 and conducts most of the remaining processing in the frequency domain. It should be noted that system 400 includes one or more mono audio coders 410 since each channel of the input audio signal may need its own mono coder, and these mono coders do not necessarily need to be the same (e.g., bit rates for the one or more mono audio coders 410 ought to be different). Furthermore, some channels that are of no particular importance may not be assigned any mono coder. A perceptual weighting 470 operation (e.g., applying one or more weighting terms or coefficients) utilizes the spectral masking effects of human perception. Following the perceptual weighting 470 operation, quantization 475 is performed. In at least one embodiment, the quantization 475 has the feature of preserving source statistics. The quantized signal is transformed into a bit stream by an entropy coder 480. The perceptual weighting 470, the quantization 475, and the entropy coder 480 uses the PSDs of the decorrelated channels, which are provided by a PSD modeling component 485.

In at least one embodiment, the decoding of the original signal is basically the inverse of the encoding process described above, which includes decoding of quantized samples, inverse perceptual weighting, inverse time-frequency transform, inverse hierarchical decorrelation, and denormalization.

It should be noted that details of the implementation of the system illustrated in FIG. 4 and described above will be apparent to those skilled in the art.

Figure 5:
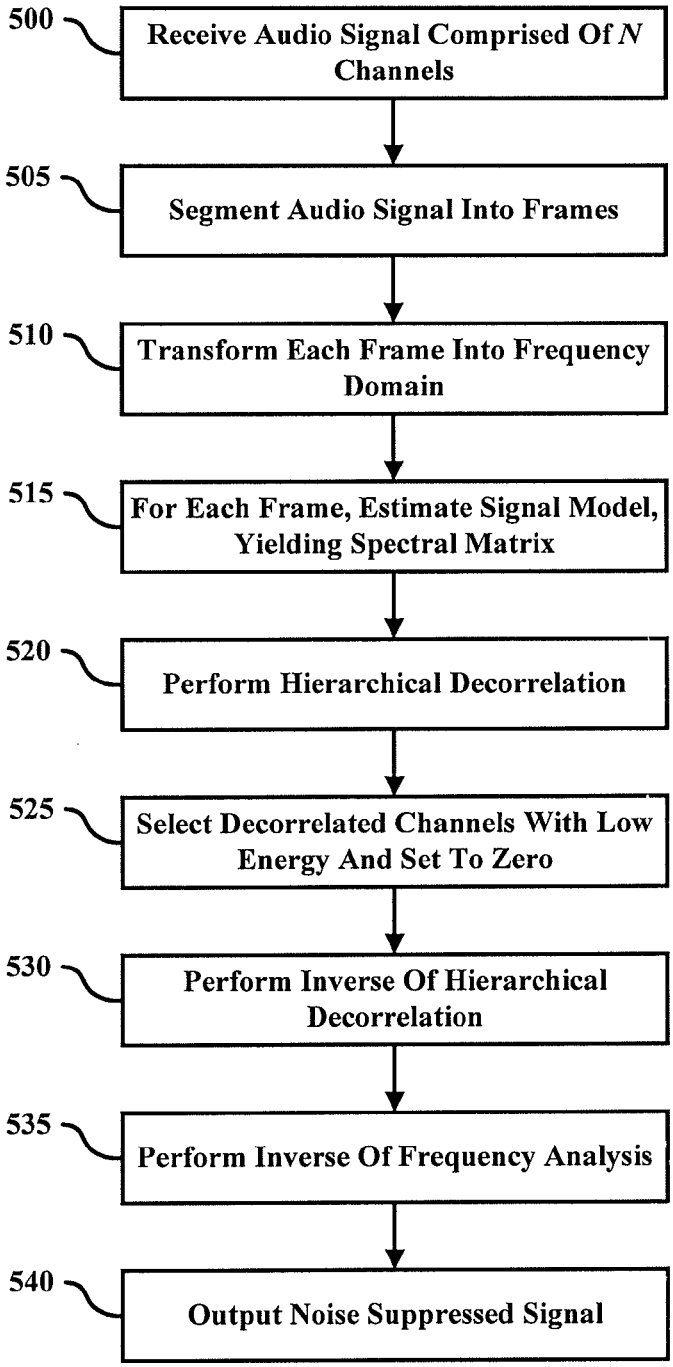
FIG. 5 is a flowchart illustrating an example method for noise suppression using hierarchical decorrelation according to one or more embodiments described herein.
Figure 6:
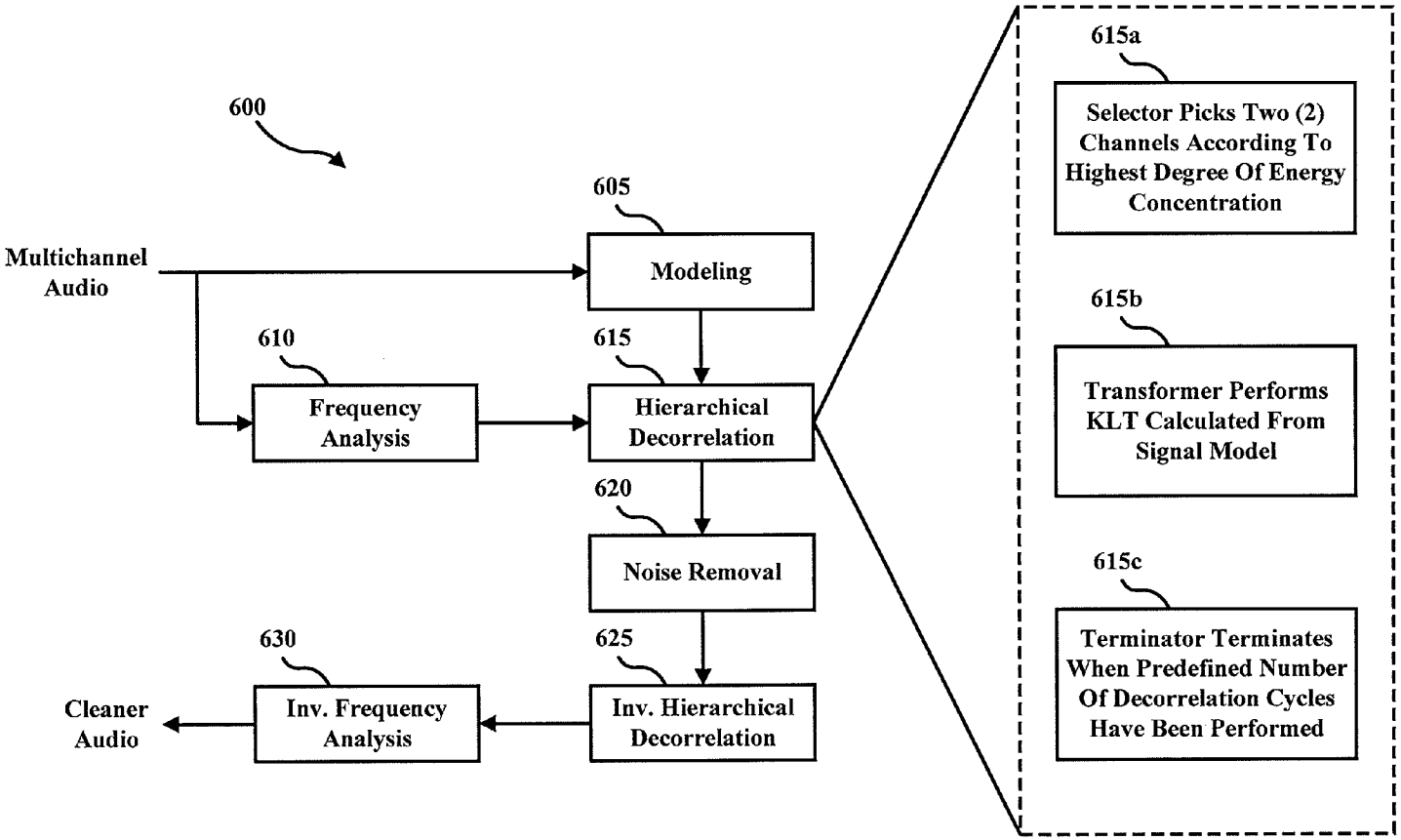
FIG. 6 is a block diagram illustrating an example noise suppression system including hierarchical decorrelation according to one or more embodiments described herein.

According to another embodiment, the hierarchical decorrelation algorithm of the present disclosure may be implemented as part of noise suppression processing, as illustrated in FIGS. 5 and 6. An example purpose for applying hierarchical decorrelation to noise suppression is, given a noise-contaminated multichannel audio signal, to yield a cleaner signal. As will be further described below, implementing hierarchical decorrelation in noise suppression allows for identifying noise since noise is usually uncorrelated with a source and has small energy. In other words, because a sound source and noise are usually uncorrelated, but are mixed in the provided audio, decorrelating the audio effectively separates the two parts. Once the two parts are separated, the noise can be removed. Furthermore, the adjustable trade-off between efficiency and complexity in such an application of hierarchical decorrelation to noise suppression allows the particular use to be tailored as necessary or desired.

Several key features of the following application of hierarchical decorrelation to noise suppression processing include: (1) the application is a frequency domain calculation; (2) two channels are selected each cycle (m=2); (3) channel selection is based on the degree of energy concentration; and (4) termination is based on complexity. It should be understood that the above features/constraints are exemplary in nature, and one or more of these features may be removed and/or altered depending on the particular implementation.

FIG. 5 illustrates an example process for performing noise suppression using hierarchical decorrelation according to one or more embodiments described herein. Additionally, FIG. 6 illustrates an example noise suppression system corresponding to the process illustrated in FIG. 5. In the following description, reference may be made to both the process shown in FIG. 5 and the system illustrated in FIG. 6.

Referring to FIG. 5, the process for noises suppression begins in step 500 where an audio signal comprised of N channels is received. In step 505, the audio signal is segmented into frames and each frame is transformed into a frequency domain representation in step 510. In at least one embodiment, the noise suppression system 600 may perform frequency analysis 610 on each frame of the signal to transform the signal into the frequency domain.

The process then continues to step 515 where for each frame, a signal model, which yields a spectral matrix, is extracted (e.g., by modeling component 605 of the example noise suppression system shown in FIG. 6).

The frequency representation obtained from step 510 may be used with the signal model from step 515 to perform hierarchical decorrelation in step 520 (e.g., by feeding the frequency representation and the signal model into hierarchical decorrelation component 615 as shown in FIG. 6). In at least one embodiment, the hierarchical decorrelation in step 520 may proceed in a manner similar to the hierarchical decorrelation algorithm illustrated in FIG. 1 and described in detail above. For example, in at least one embodiment, hierarchical decorrelation 520 may be performed with the following example configuration (represented in FIG. 6 by components 615*a*, 615*b*, and 615*c*):

Referring now to FIG. 6, the Selector component 615*a* (e.g., Selector 110 as shown in FIG. 1) picks the two (2) channels according to the highest degree of energy concentration.

The Transformer component 615*b* (e.g., Transformer 120 as shown in FIG. 1) performs KLT, which is calculated from the signal model (e.g., obtained from the modeling component 605 illustrated in FIG. 6).

The Terminator component 615*c* (e.g., Terminator 130 as shown in FIG. 1) terminates the decorrelation stage when a predefined number of decorrelation cycles have been performed (e.g., based on the computational complexity).

Following the hierarchical decorrelation in step 520, the process continues to step 525, where the decorrelated channels with the lowest energies are set to zero (e.g., by the noise removal component 620 of the example system shown in FIG. 6). In step 530, the inverse of hierarchical decorrelation is performed and in step 535 the inverse of frequency analysis is performed (e.g., by inverse hierarchical decorrelation component 625 and inverse frequency analysis component 630, respectively). The process then moves to step 540 where the output is a noise suppressed signal.

Figure 7:
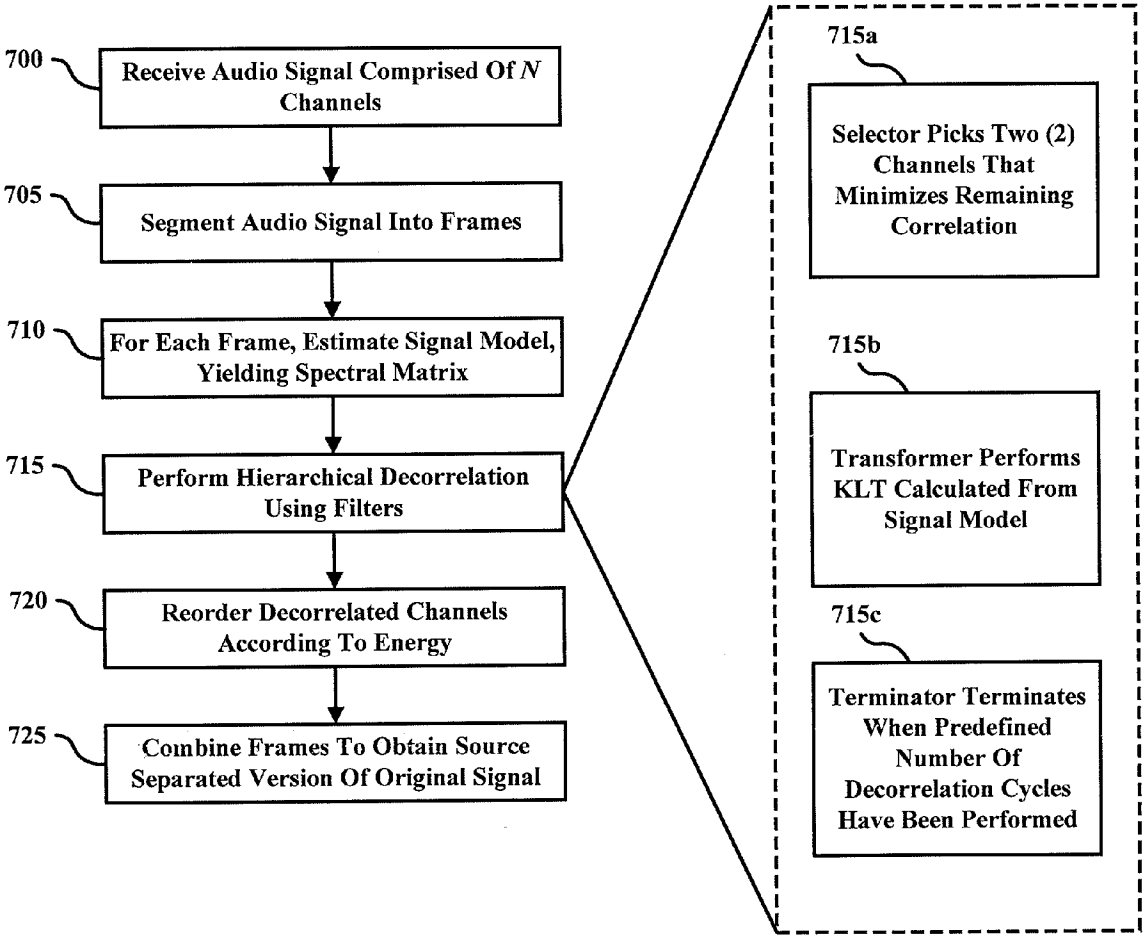
FIG. 7 is a flowchart illustrating an example method for applying hierarchical decorrelation to source separation according to one or more embodiments described herein.

In yet another embodiment of the present disclosure, the hierarchical decorrelation algorithm described herein may be applied to source separation, as illustrated in FIG. 7. An example purpose for applying hierarchical decorrelation to source separation is, given a multichannel audio signal, which is a mixture of multiple sound sources, yield a set of signals that represent the sources. As will be further described below, implementing hierarchical decorrelation in source separation allows for improved identification of sound sources since sound sources are usually mutually uncorrelated. Hierarchical decorrelation is also adaptable to changes of sources (e.g., constantly-moving or relocated sources). Further, as with the applications of hierarchical decorrelation to audio compression and noise suppression, the application of hierarchical decorrelation to source separation involves an adjustable trade-off between efficiency and complexity such that the particular use may be tailored as necessary or desired.

Several key features of the following application of hierarchical decorrelation to source separation include: (1) the application is a time domain calculation; (2) two channels are selected each cycle (m=2); (3) channel selection is based on minimizing the remaining correlation; and (4) termination is based on complexity (e.g., computational complexity). As with the other applications of hierarchical decorrelation described above, it should be understood that the above features/constraints of the application of hierarchical decorrelation to source separation are exemplary in nature, and one or more of these features/constraints may be removed and/or altered depending on the particular implementation.

FIG. 7 illustrates an example process for performing source separation using hierarchical decorrelation according to one or more embodiments described herein. The process begins in step 700 where an audio signal comprised of N channels is received. In step 705, the received signal is segmented into frames.

The process continues from step 705 to step 710 where for each frame a signal model, which yields a spectral matrix, is estimated (or extracted). The estimated signal model from step 710 may be used with the original signal received in step 700 to perform hierarchical decorrelation in step 715 (e.g., by feeding the signal model and original signal into a corresponding hierarchical decorrelation component (not shown).

In at least one embodiment, the hierarchical decorrelation in step 715 may proceed in a manner similar to the hierarchical decorrelation algorithm illustrated in FIG. 1 and described in detail above. For example, in at least one embodiment, hierarchical decorrelation in step 715 may be performed with the following example configuration (represented in FIG. 7 as steps 715*a*, 715*b*, and 715*c*):

In step 715*a*, the Selector (e.g., Selector 110 as shown in FIG. 1) may pick the two (2) channels that lead to the minimum remaining correlation between channels.

In step 715*b*, the Transformer (e.g., Transformer 120 as shown in FIG. 1) may perform KLT, which is calculated from the signal model (e.g., estimated for each frame of the signal in step 710 of the process shown in FIG. 7).

In step 715*c*, the Terminator (e.g., Terminator 130 as shown in FIG. 1) terminates the decorrelation step when a predefined number of decorrelation cycles have been performed (e.g., based on the computational complexity).

Following the hierarchical decorrelation in step 715, the process continues to step 720, where the decorrelated channels are reordered according to their energies. In step 725, the frames are combined to obtain a source separated version of the original signal.

Figure 8:
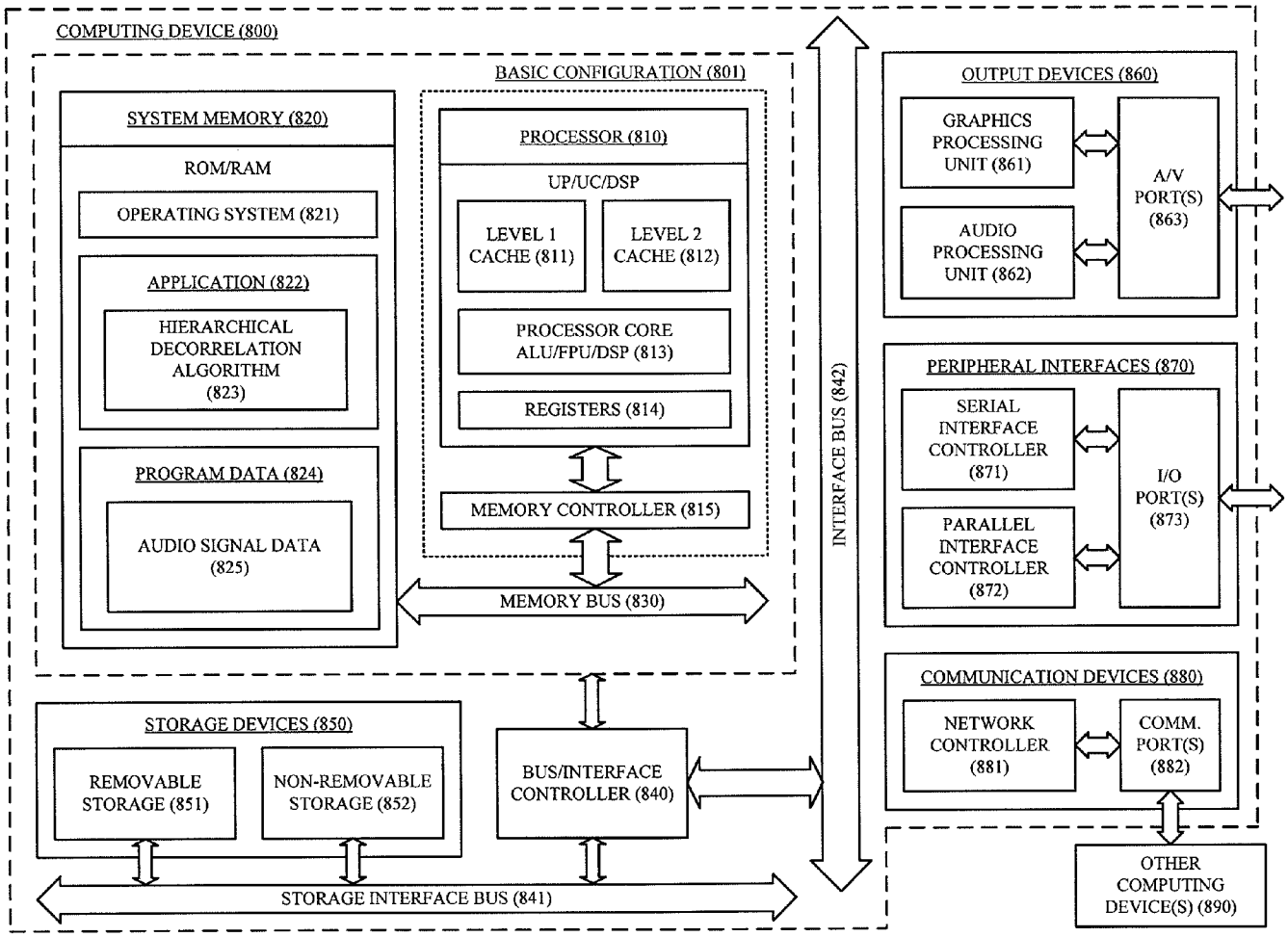
FIG. 8 is a block diagram illustrating an example computing device arranged for hierarchical decorrelation of multichannel audio according to one or more embodiments described herein.

FIG. 8 is a block diagram illustrating an example computing device 800 that is arranged for hierarchical decorrelation of multichannel audio in accordance with one or more embodiments of the present disclosure. For example, computing device 800 may be configured to apply hierarchical decorrelation to one or more of audio compression processing, noise suppression, and/or source separation, as described above. In a very basic configuration 801, computing device 800 typically includes one or more processors 810 and system memory 820. A memory bus 830 may be used for communicating between the processor 810 and the system memory 820.

Depending on the desired configuration, processor 810 can be of any type including but not limited to a microprocessor (μP), a microcontroller (μC), a digital signal processor (DSP), or any combination thereof. Processor 810 may include one or more levels of caching, such as a level one cache 811 and a level two cache 812, a processor core 813, and registers 814. The processor core 813 may include an arithmetic logic unit (ALU), a floating point unit (FPU), a digital signal processing core (DSP Core), or any combination thereof. A memory controller 815 can also be used with the processor 810, or in some embodiments the memory controller 815 can be an internal part of the processor 810.

Depending on the desired configuration, the system memory 820 can be of any type including but not limited to volatile memory (e.g., RAM), non-volatile memory (e.g., ROM, flash memory, etc.) or any combination thereof. System memory 820 typically includes an operating system 821, one or more applications 822, and program data 824. In at least some embodiments, application 822 includes a hierarchical decorrelation algorithm 823 that is configured to decompose the channel decorrelation process into multiple low-complexity steps. For example, in one or more embodiments the hierarchical decorrelation algorithm 823 may be configured to select m channels, out of an input signal consisting of N channels, to perform decorrelation on, where the selection of the m channels (e.g., by the Selector 110 as shown in FIG. 1) is based on one or more of a number of different criteria (e.g., number of bits saved for compression, degree of energy concentration, remaining correlation, etc.), which may vary depending on the particular application (e.g., audio compression, noise suppression, source separation, etc.). The hierarchical decorrelation algorithm 823 may be further configured to perform a unitary transform (e.g., KLT) on the selected m channels, resulting in m decorrelated channels, and to combine the m decorrelated channels with the remaining N-m channels to form an N-channel signal again.

Program Data 824 may include audio signal data 825 that is useful for selecting the m channels from the original input signal, and also for determining when additional decorrelation cycles should be performed. In some embodiments, application 822 can be arranged to operate with program data 824 on an operating system 821 such that the hierarchical decorrelation algorithm 823 uses the audio signal data 825 to select channels for decorrelation based on the number of bits saved, the degree of energy concentration, or the correlation remaining after selection.

Computing device 800 can have additional features and/or functionality, and additional interfaces to facilitate communications between the basic configuration 801 and any required devices and interfaces. For example, a bus/interface controller 840 can be used to facilitate communications between the basic configuration 801 and one or more data storage devices 850 via a storage interface bus 841. The data storage devices 850 can be removable storage devices 851, non-removable storage devices 852, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 820, removable storage 851 and non-removable storage 852 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media can be part of computing device 800.

Computing device 800 can also include an interface bus 842 for facilitating communication from various interface devices (e.g., output interfaces, peripheral interfaces, communication interfaces, etc.) to the basic configuration 801 via the bus/interface controller 840. Example output devices 860 include a graphics processing unit 861 and an audio processing unit 862, either or both of which can be configured to communicate to various external devices such as a display or speakers via one or more A/V ports 863. Example peripheral interfaces 870 include a serial interface controller 871 or a parallel interface controller 872, which can be configured to communicate with external devices such as input devices (e.g., keyboard, mouse, pen, voice input device, touch input device, etc.) or other peripheral devices (e.g., printer, scanner, etc.) via one or more I/O ports 873.

An example communication device 880 includes a network controller 881, which can be arranged to facilitate communications with one or more other computing devices 890 over a network communication (not shown) via one or more communication ports 882. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 800 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 800 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity;

control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for decorrelating channels of an audio signal during audio compression, the method comprising:

selecting a plurality of the channels of the audio signal based on number of bits saved for audio compression;

performing a unitary transform on the selected plurality of channels, yielding a plurality of decorrelated channels;

combining the plurality of decorrelated channels with remaining channels of the audio signal other than the selected plurality; and determining whether to further decorrelate the combined channels based on computational complexity.

2. The method of claim 1, further comprising:

responsive to determining not to further decorrelate the combined channels, passing the combined channels as output.

3. The method of claim 1, wherein the selection of the plurality of channels is further based on degree of energy concentration and/or remaining correlation.

4. The method of claim 1, wherein selecting the plurality of channels includes identifying one or more of the channels of the audio signal having a higher energy concentration than the remaining channels.

5. The method of claim 1, wherein selecting the plurality of channels includes identifying one or more of the channels of the audio signal that minimizes remaining correlation.

6. The method of claim 1, wherein the unitary transform is a Karhunen-Loève transform (KLT).

7. The method of claim 1, wherein the plurality of channels is two.

8. A system for decorrelating a multichannel audio signal during audio compression, the system comprising:

one or more processors; and a non-transitory computer-readable medium coupled to said one or more processors having instructions stored thereon that, when executed by said one or more processors, cause said one or more processors to perform operations comprising:

selecting a plurality of channels of the audio signal based on number of bits saved for audio compression;

performing a unitary transform on the selected plurality of channels, yielding a plurality of decorrelated channels;

combining the plurality of decorrelated channels with remaining channels of the audio signal other than the selected plurality; and determining whether to further decorrelate the combined channels based on computational complexity.

9. The system of claim 8, wherein the one or more processors are caused to perform further operations comprising:

responsive to determining not to further decorrelate the combined channels, passing the combined channels as output.

10. The system of claim 8, wherein the selection of the plurality of channels is further based on degree of energy concentrations and/or remaining correlation.

11. The system of claim 8, wherein the one or more processors are caused to perform further operations comprising:

selecting the plurality of channels by identifying one or more of the channels of the audio signal having a higher energy concentration than the remaining channels.

12. The system of claim 8, wherein the one or more processors are caused to perform further operations comprising:

selecting the plurality of channels by identifying one or more of the channels of the audio signal that that minimizes remaining correlation.

13. The system of claim 8, wherein the unitary transform performed by the one or more processors is a Karhunen-Loève transform (KLT).

14. The system of claim 8, wherein the plurality of channels is two.

15. An apparatus comprising:

one or more audio compression components; and a decorrelation processor operable to:

select a plurality of channels of the audio signal based on number of bits saved for audio compression by the one or more audio compression components;

perform a unitary transform on the selected plurality of channels to yield a plurality of decorrelated channels;

combine the plurality of decorrelated channels with remaining channels of the audio signal other than the selected plurality; and output the combined channels to the one or more audio compression components.

16. The apparatus of claim 15, wherein the decorrelation processor is operable to:

determine whether the combined channels should be further decorrelated based on computational complexity; and responsive to determining that the combined channels should not be further decorrelated, pass the combined channels as output to the one or more audio compression components.

17. The apparatus of claim 16, wherein the decorrelation processor is operable to stop decorrelating the combined channels when a predefined maximum cycle is reached.

18. The apparatus of claim 15, wherein the decorrelation processor is operable to calculate the unitary transform from a quantized signal model generated for each frame of the audio signal and a frequency domain representation of each frame of the audio signal.

19. The apparatus of claim 18, wherein the signal model for each frame yields a spectral matrix.

20. The apparatus of claim 15, wherein the decorrelation processor is operable to select the plurality of channels of the audio signal by identifying one or more of the channels of the audio signal that saves the most bits for audio compression by the one or more audio compression components.

21. The apparatus of claim 15, wherein the decorrelation processor is operable to select the plurality of channels of the audio signal by identifying one or more of the channels of the audio signal that minimizes remaining correlation.

22. The apparatus of claim 15, wherein the unitary transform performed by the decorrelation processor is a Karhunen-Loève transform (KLT).

* * * * *